United States Patent [19]

Eliseev et al.

[11] 4,093,448

[45] June 6, 1978

[54] METHOD OF PRODUCING PELLETS FROM ORE CONCENTRATES

[76] Inventors: Stanislav Borisovich Eliseev, ulitsa Peshestreletskaya, 115, kv. 1, Voronezh; Jury Alexandrovich Butskoi, selo Podgornoe, ulitsa 9 Yanvarya, 31, Voronezhskaya oblast, Ramonsky raion; Vladimir Sergeevich Dmitrievsky, ulitsa Studencheskava, 31, kv. 21, Voronezh; Albina Andreevna Golubeva, ulitsa Koltsovskaya, 77, kv. 41, Voronezh; Vladimir Mikhailovich Ozerov, ulitsa Svobody, 59, kv. 12, Voronezh; Valentin Stepanovich Volkov, ulitsa Khalzunova, 37, kv. 50, Voronezh; Iya Petrovna Vasninova-Shipulina, ulitsa Tsimlyanskaya, 2, kv. 32, Voronezh, all of U.S.S.R.

[21] Appl. No.: 726,968

[22] Filed: Sep. 27, 1976

Related U.S. Application Data

[63] Continuation of Ser. No. 519,018, Oct. 29, 1974, abandoned.

[51] Int. Cl.[2] ..... C22B 1/08

[52] U.S. Cl. ..... 75/3

[58] Field of Search ..... 75/3, 267

[56] References Cited

U.S. PATENT DOCUMENTS 3,617,254 11/1971 Imperato ..... 75/3

*Primary Examiner*—Peter D. Rosenberg

*Attorney, Agent, or Firm*—Holman & Stern

[57] ABSTRACT

The present invention relates to ore lumping processes in ferrous metallurgy and can be most efficiently utilized in non-roasting methods of producing pellets from iron ore concentrates with moisture content of 7 to 15%.

The given method of producing pellets provides for preliminary preparation of a mixture from ore concentrate with particle size less than 0.83 mm and binding material in the form of calcium oxide and magnesium oxide followed by hydration of this mixture to produce a hydrated mixture, thereafter this hydrated mixture is introduced into ore concentrate to produce a homogeneous mixture containing 4 to 15 weight percent of binding material with the following pelletizing of the homogeneous mixture to produce pellets by curing them in the medium of saturated steam at a temperature of 120–225° C during a time period of 1 to 12 hours.

9 Claims, 3 Drawing Figures

METHOD OF PRODUCING PELLETS FROM ORE CONCENTRATES

This is a continuation of application Ser. No. 519,018 filed Oct. 29, 1974, now abandoned.

BACKGROUND OF THE INVENTION

The present invention relates to pelletizing ores in ferrous metallurgy and more specifically to the methods of producing pellets from ore concentrates with a particle size less than 0.83 mm.

The present invention can be most efficiently utilized in non-roasting methods of producing pellets from iron ore concentrates containing 7 to 15% of moisture with the use of binding materials comprising active calcium and magnesium oxides as well as in producing pellets from concentrates of chrome, manganese ores and non-ferrous metal ores.

The method may find application in pelletizing sludge resulted from scrubbing at metallurgical works with the purpose of utilizing said sludge.

Metallurgical industry in every country of the world from year to year sets forth ever stricter requirements as with regard to the quality of iron ore raw materials because this, in many respects, determines the performance characteristics of blast furnaces. One of the most important requirements is to achieve a constant chemical composition of raw material and its stable particle size. Therefore, more and more attention is paid to the problems of beneficiation, averaging and lumping of ores and ore concentrates.

Up to the present time the most wide-spread method of lumping ores is, agglomeration, that is sintering of the ore charge to produce cake agglomerates on metal grates by blowing a gas and air mixture at a temperature higher than 1400° C through the ore burden.

However, involvement in the metallurgical conversion process of increasing amounts of fine-powder (rich in ferrum) concentrates and more severe requirements as to the mechanical strength of the agglomerate have necessitated further development of agglomeration, both in the direction of improving sintering machinery and by introducing into the process additional technological operations such as preliminary pelletization of the ore charge, sizing of agglomerate, etc.

Under these conditions pelletization of fine-powder concentrates becomes a more promising method of lumping.

Pellets possess a high mechanical strength, good reduction, and uniform chemical and grain composition.

When compared with agglomerate, they are more stable in storage, transportation and rehandling, making it possible to solve more efficiently the problem of transporting iron ore materials.

The pellet producing process widely used all-over the world consists in the pelletization of iron ore concentrate with a following high-temperature sintering of nodules at a temperature of 1250°–1300° C, generally by conveyor-type sintering machines.

As the sintering temperature and the basic technological equipment in producing pellets or agglomerates do not differ significantly, these two methods suffer from the following disadvantages:

(1) use of expensive heat-resistant trolleys in sintering machines, requiring frequent repairs and replacement;

(2) need for cooling roasted pellets or agglomerate, for which, a special system of cooling devices is required. Under these conditions, sharp cooling of the sintered product results in decreasing its mechanical strength and increasing the content of small grain sizes;

(3) about 25% of the ready product is continuously returned to the process, which additionally increases heat consumption and reduces the output capacity of sintering plants as compared with their potential;

(4) high consumption of electric power to drive air-blowing plants;

(5) high capital investments needed for building sintering plants;

(6) roasting of agglomerate and pellets is accompanied by substantial air pollution by combustion products, sulphuric acid gas and dust.

Dust emission in producing pellets is somewhat lower than in agglomeration, however in addition to air pollution, oxygen is consumed thus impoverishing the air because roasting of pellets accompanied with their oxidation;

(7) oxidizing roasting of pellets is not responsible for their blast furnace conversion.

The above-mentioned disadvantages can be eliminated in non-roasting pellet-producing methods. These methods permit production of pellets containing a reducing agent in the form of powder coke, coal or the like material.

From non-roasting methods, one used on an industrial basis is the "Grängcold" method of producing cement-bound pellets developed by the Grängesberg company (Sweden). The plants of this company produce about 1.5 mln t of these pellets annually.

Accoding to the Grängcold method, a thoroughly blended mixture of iron ore concentrate and a binder in the form of milled portland cement clinker (in a proportion of 90 and 10 weight percent) is pelletized by means of pan (disk) pelletizers, then interspersed with the damp primary concentrate to prevent conglutination and retain the strength of raw granules, and hardened by curing in continuous-flow silos during 30 to 40 hours, afterwards it is held during 5 to 7 days in a bin storage and during another 2–3 weeks in an outdoor storage.

The principal advantages of the Grangcold process are as follows:

(1) reduced capital investments for building;

(2) reduced pellet production cost;

(3) increased output capacity of blast furnaces due to a higher reducibility on non-roasted pellets;

(4) decreased air pollution in the production of these pellets.

The disadvantages of the Grangcold process:

(1) a prolonged production cycle;

(2) the need for interspersing of raw granules with concentrate with further separation of the latter from pellets;

(3) increased content of silicon dioxide ($SiO_2$) by 2–2.5% in pellets resulted from the addition of 10% of portland cement (milled portland cement clinker);

(4) the process is economically favourable only with a high content of ferrum in concentrate and cheap cement.

The above disadvantages can be obviated by a non-roasting method with hydrothermal (autoclave) hardening of pellets or briquettes. This method is being most actively developed in the USSR, Sweden and USA and now nears its introduction in the industry.

Hardening of the pelletized product according to this method is effected by curing it in autoclaves in the medium of saturated steam at a temperature of 100°-350° C.

Under these conditions a chemical interaction takes place between the components of the pelletized mixture due to which the pellets acquire strength needed for metallurgical conversion.

The duration of autoclave treatment is 1 to 24 hours depending on the reactivity of mixture components, treating temperature and the required strength of the product.

One of such non-roasting methods with hydrothermal hardening is described in the U.S. Pat. No. 3,235,371. This method implies mixing to produce a homogeneous mixture of fine-ground iron ore concentrate with moisture content from 3 to 14 weight percent with a ground binding material taken in the amount of 5 to 20 weight percent to be selected from the group consisting of calcium hydroxide, magnesium hydroxide, calcium oxide, magnesium oxide, and mixtures thereof with the addition of a catalyst in the form of alkali or salts of alkali metals in the amount of 0.25 to 1 weight percent, followed by pelletizing or briquetting the mixture with further hardening of pellets or briquettes in the medium of steam at a temperature of 100° to 350° C.

The patent description states that the moisture content of the lumped product before the hydrothermal reaction should be preferably within the limits of 3 to 8 weight percent or better within the limits of 4 to 5 weight percent. The examples given deal with the production of briquettes from a mixture of dry iron ore concentrate added with 10, 15 and 20 weight percent of slaked lime (calcium hydroxide), 0.5 and 1% of sodium carbonate. Prior to that, 4–5% of water is added to the iron ore concentrate.

Multiple experiments have been carried out in the course of developing the proposed pellet production method which have made clear that the above described known method under the parameters and compositions referred is substantially suitable for producing briquettes.

In pelletizing the mixture the moisture content of raw pellets in the majority of cases is from 7 to 10 weight percent, i.e. higher than the most preferable moisture content limits of the product before the hydrothermal treatment as stated in the U.S. patent. Therefore, to produce tough pellets, the latter should undergo drying before the hydrothermal treatment to reduce their moisture content at least down to 5 weight percent. However, the need for this operation is not stated in the appended claims or in the patent description.

Application of a catalyst is not instrumental in improving the strength of raw granules in a degree which could made unnecessary their drying prior to the hydrothermal treatment.

Inclusion of up to 20% of the binding material recommended by the patent in the lumped mixture is also permissible only in briquetting.

Production of pellets from the mixture containing more than 15 weight percent of lime is practically difficult due to an increased content of finely dispersed particles of calcium hydroxide in this mixture. In the course of pelletizing this mixture quickly cures into small and dense clots of irregular shape which further conglomerate into large and unstable lumps, i.e. the normal pelletizing process is disturbed.

Pelletizing by this method of concentrates with moisture content higher than 9% is possible only when unslaked lime is used as a binding material. However, the above patent-protected method of producing a homogeneous mixture only by way of mixing the components allows no practical possibility of applying unslaked lime because it does not guarantee its complete slaking: whereas presence of unslaked lime particles in pellets inevitably leads to their reduced hardness or even to their destruction in the course of the hydrothermal treatment.

Also known is a non-roasting method of producing pellets with their hydrothermal (autoclave) hardening described in the Swedish Pat. No. 315,381. According to this patent, said method, in line with the operations similar to those of the American patent, provides for cooperative pulverization in a rod mill of iron ore concentrate and preliminarily slaked steel-smelting slag or slaked lime to an optimum degree of homogenization and drying raw pellets until they contain no more than 5 weight percent of free moisture.

Also during the compatible pulverization the mixture is activated, while prior to homogenization an optimum selective pulverization of components is effected according to their sizes to produce pellets of maximum density and hardness.

Though the above described method makes it possible to produce pellets by a non-roasting method with hydrothermal hardening it still has inherent the following disadvantages:

(1) application of slaked lime or preliminarily slaked steel-smelting slag inevitably limits the top extreme of the permisible moisture content of the primary concentrate, because with a high moisture content of concentrate it is very difficult to produce a homogeneous mixture and to pelletize it by the method according to the above-mentioned patent;

(2) the production of high-quality air-slaked lime is a complex technological process requiring, in addition to the basic operation of lime hydration, its pulverization, separation, and curing in high-capacity bins as it is adopted for example by the American practice. Complete slaking of steel-smelting slag is assumed to be even more complex, because a high content of burns is inevitable in it;

(3) selective pulverization of components and activation of the mixture in a rod mill, still come short of assuring the hardness of raw pellets sufficient for excluding their drying prior to the autoclave treatment;

(4) drying of raw pellets prior to their autoclave treatment requires an added consumption of heat and complicates the non-roasting process.

Also known is a method with hydrothermal treatment of pellets, described in the USSR Author's Certificate No. 212,276, which is distinguished from the above described ones by that the mixture of iron ore concentrate and a binding material in the form of ground unslaked lime or calcinated dolomite is kept in silos until lime is completely slaked.

This involves utilization of concentrate with a moisture content obtained after its beneficiation. During this curing period a hydration reaction takes place between calcium oxide of lime and the moisture of concentrate resulting in drying and activation of the mixture. Raw pellets resulting from pelletizing of this mixture are dried prior to the hydrothermal reaction until their moisture content is 2 to 5%.

This method, due to the application of unslaked lime, permits pelletization of concentrates with high moisture content.

By this method, hydration of calcium oxide (production of slaked lime) mixed with damp concentrate is carried out simpler than with separate preparation of slaked lime in the form of powdered calcium hydroxide, while chemisorption interaction taking place in the course of hydration between calcium oxide and the components of the ore portion activates the mixture and helps produce raw granules of a higher hardness than with the use of ready calcium hydroxide. However, this methods is not free of the following disadvantages.

(1) curing of the entire mixture in silos before pelletization requires high-capacity silos and a corresponding increase in capital investments;

(2) drying of raw pellets before the autoclave treatment complicates the non-roasting process and requires added heat consumption.

OBJECTS AND SUMMARY OF THE INVENTION

The object of the present invention is to obviate the above disadvantages.

The principal object of the present invention is to provide a method of producing durable non-roasted pellets without their having to be dried before the hydrothermal treatment.

Another object of the present invention is to improve the mechanical strength of raw pellets.

The object of the present invention is also to reduce the total holding capacity of silos used in the process of calcium oxide hydration.

One more object of the present invention is to provide a possibility for pelletizing ores and concentrates with moisture content of 7 to 15% without their preliminary drying by utilizing, during the calcium oxide hydration, the effect of chemical interaction of said oxide and the moisture of the concentrate accompanied with the liberation of large amount of heat during said interaction.

These and other objects are achieved by provision of a method of producing pellets from ore concentrates with a particle size less than 0.83 mm, consisting in that such concentrate is mixed with a binding material selected from a group containing calcium oxide and magnesium oxide to produce a homogeneous mixture from said components, then the homogeneous mixture is pelletized to produce pellets and the pellets are cured in the medium of saturated steam at a temperature from 100° to 350° C within a time period sufficient for their hardening, according to the invention the mixture of ore concentrate and binding material is prepared in advance, then is subjected to hydration and upon producing the homogeneous state said hydrated mixture is introduced into ore concentrate so that the homogeneous mixture contains 4 to 15% of binding material.

The above method allows fluxing pellets sufficiently durable for their further multiple rehandling, transportation and usage in the blast furnace conversion to be produced from various iron ore concentrates with moisture content of 7 to 15% by way of pelletizing and hydrothermal treatment of raw pellets without their preliminary drying-up.

This is achieved because the introduction into the iron ore concentrate of the preliminarily hydrated mixture of lime and ore concentrate in an amount sufficient to provide 4 to 15% of the binding material in the pellet charge makes it possible to improve durability of raw pellets as much as 1.5–5 times. The indicated limits of the binding material content are in agreement with the requirements of the optimal basicity of iron ore pellets and are able to assure good nodulizing of the charge.

This is achieved also because the components of the mixture subject to hydration are taken in a proportion: 12 to 30 weight percent of unslaked lime, which is a binding material, and 70 to 88 weight percent of ore concentrate. Within the above limits, the proportion of components calculated with account taken of the initial moisture content of the concentrate and the activity of lime provides for heating the mixture in the course of hydration to a temperature of maximum proximity to 100° C. Under these conditions the hydration of lime is accelerated and accompanied by intensive evaporation of moisture from the concentrate, whereas chemisorption interaction takes place on the surface of lime and concentrate particles. The hydrated mixture produced under the above conditions is of a low moisture content (in practice it can be close to 0%) and displays a higher reactivity in producing raw and autoclaved pellets.

The proportion of 12 weight percent of unslaked lime and 88 weight percent of concentrate corresponds to 7% moisture content of concentrate and 90% of lime activity with a heat utilization factor equal to 0.8.

The proportion of 30% of unslaked lime and 70% of concentrate is possible with a concentrate moisture content of about 15% and a low heat utilization factor equal to 0.4. This proportion of lime can be dictated by the requirements of a high basicity of pellets. The lime content reduced to less than 12% and increased to more than 30% is not practical because in the first case, artificial drying of concentrate will be needed, while in the second case — water must be added to it which will lead to the corresponding increase in the moisture content of the homogeneous mixture (pellet charge).

Durable pellets are produced according to the instant method also because the lime content in the hydrated mixture is taken as much as 1.5–5 times higher than in the homogeneous mixture. Due to the above, the mixture hydration process occurs under the most favourable conditions, the moisture content of the homogeneous mixture appear to be the least possible (in every actual case) while the content of fine-dispersed calcium hydroxide in this mixture comes within the permissible limits.

Said extreme limits of the proportion of calcium oxide in the hydrated mixture and in the pellet charge are possible with the moisture content of concentrate close to 12%. With this, the proportion equal to 1.5 corresponds to the 15% content of lime in the charge of pellets, while that equal to 5 corresponds to 4% of lime.

With the moisture content of concentrate below 12% the indicated limits can be somewhat widened both in the upper and lower extremes.

However, if the moisture content of concentrate exceeds 12%, then with the above proportion reduced to values below 1.5, the lime content in the charge of pellets will exceed 15%, while with the above proportion in excess of 5, the moisture content in the charge of pellets will be higher than 10% which practically makes impossible the process of pelletizing this charge.

This proportion versus the initial moisture content of concentrate with various moisture contents in the charge of pellets will be represented graphically below in the description.

Hydration of lime mixed with damp concentrate according to the present method is effected in continuous-action reactor bins during a period of 0.5 to 3 hours. Because of the above, the most favourable thermal and moisture conditions are provided for intensive and complete proceeding of the lime hydration process and activation of the entire mixture with a very simple structural solution known in the art. The required period of hydration within the above mentioned limits should be defined more exactly by experiments depending on the holding capacity of reactor bins, efficiency of their thermal insulation, quality of lime used, and other production factors.

BRIEF DESCRIPTION OF THE DRAWINGS

In order to make the present invention more readily understood some actual embodiments thereof will be described below in more detail with reference to the accompanying drawings, in which.

DETAILED DESCRIPTION OF PREFERRED EMBODIMENTS

Production of pellets according to the invention is effected as follows.

At the first stage of pellet production an activated hydrated mixture is produced of lime taken as a binding material, and concentrate with a minimum moisture content in the mixture. For this purpose unslaked lime pulverized to contain at least 90% of minus 0.1 mm size is mixed with iron ore concentrate in such a manner as to obtain a uniformly blended mass and is subjected to hydration in continuous-action reactor bins. Concentrates should be of 7 to 15% moisture content. Concentrate particles should be smaller than 0.83 mm to contain at least 50% of minus 0.05 mm size.

Lime should be preferably high-activity containing 85% or more of calcium oxide and magnesium oxide, the latter should not account for more than 5% in the above amount. Use of lower activity lime will require a larger amount of the latter which will result in a decreased metallurgical value of pellets because of a higher content of calcium carbonate in them and a decreased content of ferrum.

Weight proportion of lime and concentrate in preparing the hydrated mixture is from 12 to 30% of unslaked lime and from 70 to 88% of concentrate. Optimal proportions of these components within the stated limits at various moisture content of concentrate and activity of lime are illustrated graphically in FIG. 1. Herein a relation is represented between the moisture content of concentrate and the amount of unslaked lime to be added to concentrate so that hydration of lime in the mixture would proceed completely, the mixture of said components would heat in the course of hydration to a temperature of 100° C and upon the hydration would possess higher reactivity and contain not more than 2 weight percent of free moisture.

Figure 1:
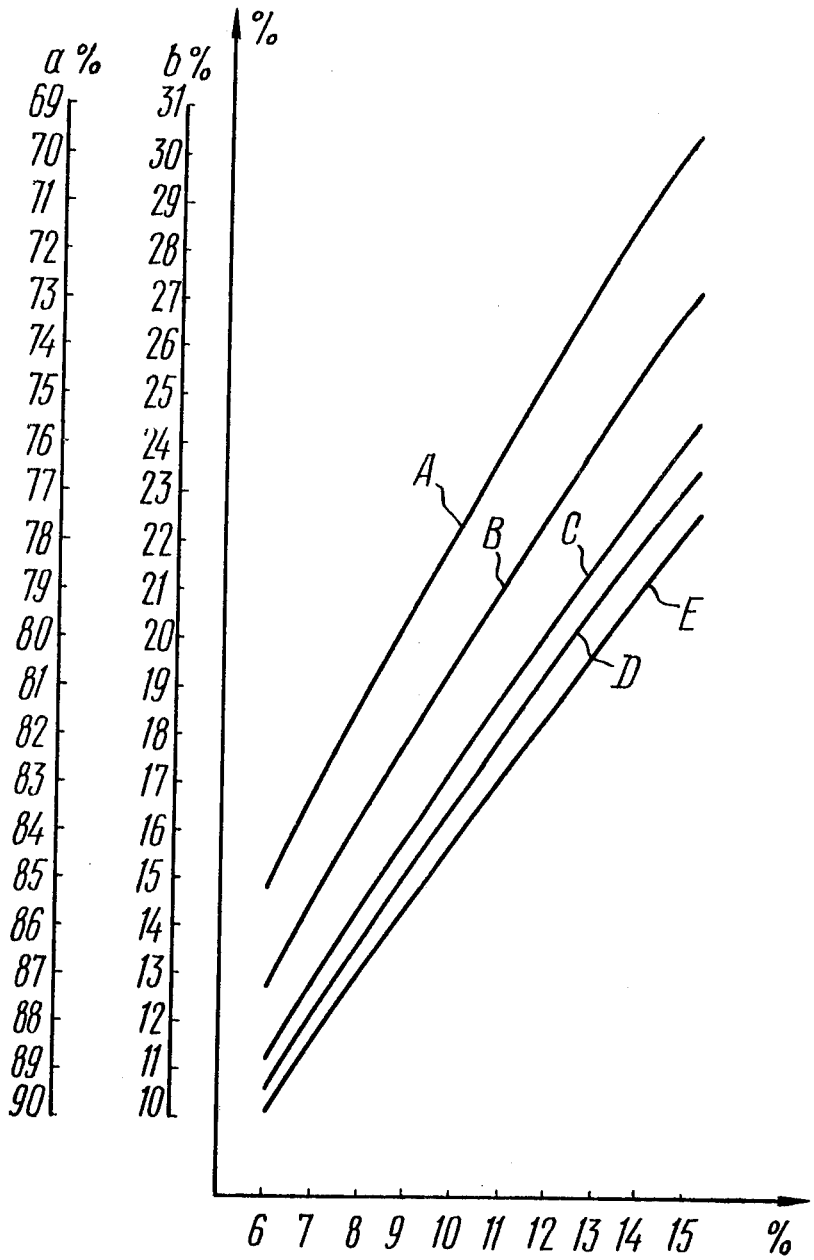
FIG. 1 - graphic illustration of the optimal content of lime in the hydrated mixture.

In FIG. 1, curves "A", "B", "C", "D", "E" are plotted on the basis of the thermal balance of the hydration process of lime mixed with damp concentrate depending on the activity of lime and the moisture content of concentrate. In this, account is taken of such production factors as partial hydration of lime during its storage, loss of heat to the ambient medium in the course of mixing, transportation and holding the mixture in reactor bins. The effect of these factors leading to incomplete utilization of heat liberated during hydration of calcium oxide is taken into consideration through a heat utilization factor "$\phi$" taken to be equal to 0.8. In FIG. 1, Y-axis (line "*a*") gives quantitative values in weight percent of concentrate, while line "*b*" gives quantitative values in weight percent of unslaked lime. X-axis gives moisture content of concentrate in percent. Curves "A" and "B" are plotted basing on the activity of lime (total content of calcium oxide and magnesium oxide) equal to 85% and the factor "$\phi$" equal to 0.4 and 0.6 respectively, while curves "C", "D" and "E" - correspondingly at the activity of lime from 85% to 95% and the factor "$\phi$" equal to 0.8.

Calculated proportions given in FIG. 1 can be defined more exactly in practical realization of the method proceeding from a difference between the moisture content of hydrated mixture as adopted in calculation to be equal to 2% and the actual value obtained under the real production conditions.

The calculated moisture content of the mixture excludes incomplete slaking of lime in it because of a lack of moisture at a casual short term increase in the lime activity and disturbed operating mode of mixers.

As the moisture content of the hydrated mixture will later bring its effect on that of the pelletized charge, in practice it is desirable to decrease the moisture content of the mixture down to 1% by a corresponding increase of the lime content in it above the calculated value. This is possible under the stable production conditions with the use of stable quality lime and high-efficiency mixers.

Selection of machinery for mixing concentrate and unslaked lime is determined by the initial moisture content of concentrate and the proportion of said components corresponding to this moisture content. With the moisture content of concentrate below 9% a rod mill can be employed as a mixer. Within a wide range of the concentrate moisture content of 7 to 15% disintegrators can be successfully employed. It is also possible to employ continuous-flow runner mills, provided their output capacity and the design minimize a loss of heat from the mixture before it is brought to a reactor bin.

On completion of the mixing process, the mixture is delivered to continuous-action reactor bins wherein hydration of unslaked lime takes place in interaction with the moisture from the concentrate, the mixture in this process is heated to a temperature of 100° C and its moisture content is reduced due to evaporation of water. The hydrated mixture thus produced is distinguished by a higher reactivity of its components and therefore to a certain extent tends to setting and bridging in the course of long-term curing in bins. These phenomena are eliminated during hydration of the mixture due to the non-stop displacement of the mixture in continuous-action reactor bins. At the final stages of the pellet production the capacity of the mixture holding bins should be the minimum required for normal functioning of the proportioning and feeding devices.

The period of keeping the mixture in reactor bins required for complete hydration of lime is from 0.5 to 3 hours to be defined more exactly within said limits experimentally depending on the activity of lime used, rate of its hydration, capacity of reactor bins and other production factors.

The hydrated mixture delivered from reactor bins is proportioned and mixed with iron ore concentrate to produce a homogeneous mixture - charge of pellets. The proportion of the above components brings direct effect on the moisture content of the charge and also on the content of calcium oxide in it and consequently on the basicity of ready pellets.

Figure 2A:
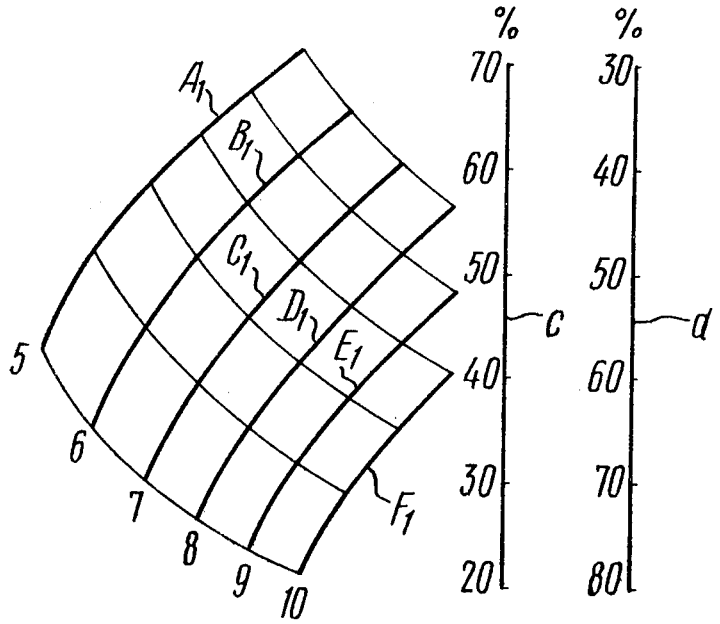
FIG. 2 *a,b* - graphic illustration of the content of the hydrated mixture and concentrate in the charge of pellets and the proportion of lime content in the hydrated mixture and in the charge of pellets at various initial moisture contents in the concentrate.
Figure 2B:
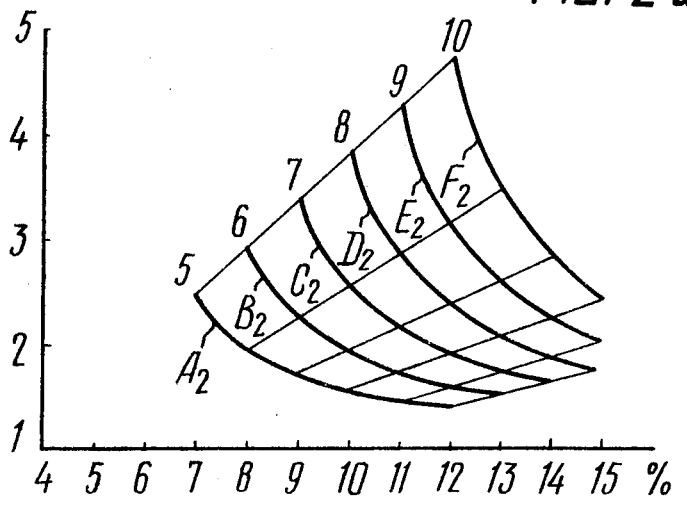

In FIG. 2, curves "$A_1$", "$B_1$", "$C_1$", "$D_1$", "$E_1$" and "$F_1$" characterize the content of hydrated mixture and concentrate in the charge of pellets,, wherein Y-axis (line "*c*") gives quantitative values in weight percent of hydrated mixture, while line "*d*" gives quantitative values in weight percent of cencentrate, X-axis gives moisture content of concentrate in %%. Curves "$A_1$", "$B_1$", "$C_1$", "$D_1$", "$E_1$" and "$F_1$" are plotted for the moisture content of the charge correspondingly from 5% to 10% depending on the initial moisture content of concentrate. Numerals at the curves indicate moisture content of the charge of pellets. In plotting these curves, moisture content of concentrate is taken variable from 7% to 15%, while that of the mixture - constant to be equal to 2%. FIG. 2*b* presents curves "$A_2$", "$B_2$", "$C_2$", "$D_2$", "$E_2$", "$F_2$" designating the proportion of lime content in the hydrated mixture and in the charge of pellets at variable initial moisture content of concentrate from 7 to 15%. The values of this proportion are plotted on Y-axis, while the quantitative values of the moisture content of concentrate in %% are plotted on X-axis. The above curves are plotted correspondingly for moisture content of the charge from 5 to 10% (numerals at the curves indicate moisture content of the charge of pellets).

For practical use of the curves in FIGS. 1 and 2 it should be taken into consideration that the indicated proportion of components in the hydrated mixture and in the charge of pellets is calculated in dry weight, while the proportion of lime - in terms of unslaked lime. Mixing of the hydrated mixture containing 1 to 2% of moisture with concentrate of the given moisture content can be effected in any known apparatus designed for producing homogeneous mixtures of materials similar to those dealt with herein. The homogeneous mixture - charge of pellets resulted from mixing is subjected to treatment in pelletizers of known designs. Pan pelletizers are more preferable for this purpose because they are able to produce more durable raw pellets as compared with drum pelletizers.

Investigations have shown that raw pellets, 18 mm in diameter, depending on the kind of concentrate and the content of lime in them possess a compressive strength from 5 to 16 kg per pellet, endure 6 to 15 drops down to a steel plate from a 100 cm height and more than 10 drops from a 50 cm height and contain 6 to 11% of moisture.

Raw pellets delivered from the pelletizer are loaded to containers or special rail cars or special-design autoclaves to a depth of 1 to 2.5 m. Within these limits an actually permissible depth (thickness) of the pellet load should be defined more accurately by experiments for each actual kind of pellets.

Containers or cars loaded with raw pellets are transferred into autoclaves wherein pellets undergo hydrothermal treatment in the medium of saturated steam at a temperature of 120° to 225° C corresponding to a gauge pressure of 2 to 25 kgf/cm$^2$ within a time period of 1 to 12 hours depending on the temperature of steam and the composition of pellets. At steam temperature of 191° C and gauge pressure of 12 kgf/cm$^2$ it takes 2 to 5 hours to give pellets the sufficient hydrothermal treatment.

In effecting the hydrothermal process in cyclic-action autoclaves it is preferable to raise steam pressure in an autoclave from 0 to 12 kgf/cm$^2$ intensively within a - concentrate period not over 1 hour, but more preferably - within 20 to 40 minutes. Pressure reduction down to the atmospheric and correspondingly reduction of pellet temperature from 191 down to 100° C should take at least 30 minutes.

It has been determined experimentally that depending on the kind (type) of concentrate and the content of lime in pellets the porosity of pellets comes within the limits of 27 to 32%. Compressive strength of 18 mm diameter pellets is 110 to 250 kg per pellet; pellets endure 10 to 25 drops from a 200 cm height until a crack or chipping is noticeable.

The cementing matter of pellets resulted from their hydrothermal treatment includes crystalline or jelly-like calcium hydrosilicates, calcium hydroferrites, ferrous hydro-garnets and in a small amount - calcium hydroxide.

Pellets produced according to the present method are weather-resistant and can be stored in the open for a long period. It has been proved by experiments that after 6 months of storage outdoors (autumn and winter seasons) the durability of pellets produced from various concentrates increases by 50% on the average due to the continuous crystallization and hardening of the cementing material.

To test the metallurgical durability of pellets the latter produced from various concentrates were heated up to 1000° C in the reducing medium; they were also subjected to the effect of rubbing and impact loads. According to the experimental data the compressive strength of pellets under said conditions increases at heating up to 600° C, slightly decreases within the temperature range of 600° to 800° C, but still remains higher than the initial strength of pellets in the cold condition; with further increase of temperture the compressive strength of pellets decreases to be about 50 kg per pellet at 1000° C. Melting starts within the temperature range of 1125° C to 1150° C depending on the kind of concentrate and the composition of pellets.

The degree of reduction of pellets during 10 minutes at a temperature of 800° C and at the delivery of hydrogen at the rate of 100 lit/hr is from 27 to 35%. Under the effect of rubbing loads, fine-grain sizes, 0.25–0 mm, are produced in pellets during this period. In the course of reduction at a temperature of about 700° C the volume of autoclaved pellets increases by 1.7–3%, while at a temperature of 1000° C they shrink as much as 8 to 13% of their initial volume, which favourably distinguishes these pellets from those hardened by way of oxidizing roasting.

Given below are the actual examples of the realization of the pellet producing method (within the principles of the present invention). It should be borne in mind that compositions and parameters brought forth in the examples do not limit the scope of use of the present invention.

EXAMPLE 1

Pellets should be produced to contain 4% of lime, from magnetite concentrate of the Kursk Magnetic Anomaly (to be called further concentrate No. 1). Chemical and grain compositions of this concentrate are given in Table 1.

To produce pellets in accordance with the present invention the components taken are the above concentrate containing 7% of moisture and a binding material in the form of unslaked lime containing 90% of active calcium oxide and magnesium oxide. Unslaked lime is preliminarily pulverized so that 100% of its particles are smaller than 0.2 mm, while the content of minus 0.1 mm size is at least 90%. This lime and the concentrate of the above moisture content are proportioned within 12% of unslaked lime and 88% of concentrate, then mixed to produce a uniform mixture to be cured in a thermostat at a temperature of 100° C during 3 hours.

The thus produced hydrated mixture containing about 2% of moisture is added to concentrate in a proportion of 1:2 (by dry weight) and both are mixed together to produce a homogeneous mixture (charge of pellets).

As a result, the amount of lime in the homogeneous mixture comes to be 4%, moisture content - about 5.5%, while a proportion ratio of lime in the hydrated mixture and in the charge of pellets is 3.

The homogeneous mixture - charge of pellets is pelletized with addition of water in a pan pelletizer in such a manner as to produce spherically shaped pellets, 18 mm in diameter, containing 7.5 to 8% of moisture.

Upon completion of pelletizing, raw pellets held in wire-mesh containers are delivered to a vertical autoclave of 30 liter capacity having internal electric heaters. Prior to that, the autoclave is filled with water so that the electric heaters are fully submerged. The lid of the autoclave is now closed airtight and the autoclave is heated within 40 minutes to a temperature of 190° C to correspond to a gauge pressure of 12 kgf/cm$^2$.

The semispherical shaping of the autoclave lid prevents condensate droplets from falling down on the pellets. Upon expiration of the 3-hour curing period under the above described parameters maintained automatically, the autoclave is cut off from the electric mains with the following 1.5 hour natural cooling and pressure reduction to the normal atmospheric. 12 hours later pellets removed from the autoclave are subjected to testing for strength by hydraulic press and by dropping from a 200 cm height down to a steel plate. The results of testing the mechanical strength of pellets (average for ten samples) are summerized in Table 2.

EXAMPLE 2

Pellets should be produced to contain 8% of lime, from magnetite concentrate resulted from magnetic beneficiation of ferruginous quartzite mined at the Kursk Magnetic Anomaly (see Table 1 -concentrate No. 1).

Said concentrate with 7% moisture content and lime containing 90% of active calcium oxide and magnesium oxide are processed similar to that described in Example 1 to produce a hydrated mixture including 12% of lime and 88% of concentrate, the moisture content of the mixture being 2%. This mixture is proportioned with concentrate containing 7% of moisture by weight, 67% of hydrated mixture and 33% of concentrate assuring a proportion ratio of lime in the hydrated mixture and in the charge of pellets equal to 1.5 and, correspondingly, the content of lime in pellets equal to 8%. The mixture and concentrate in said amounts are mixed together to produce homogeneous mixture - - charge of pellets whose moisture content is about 4%.

The thus produced charge of pellets is pelletized into raw pellets containing 6 to 6.5% of moisture, which then undergo the hydrothermal treatment with the following testing for strength similar to that described in Example 1.

EXAMPLE 3

Pellets should be produced to contain 10% of lime, from magnetite concentrate resulted from magnetic beneficiation of ferruginous quartzite mined at the Kursk Magnetic Anomaly. The chemical and grain compositions of the concentrate are given in Table 1 (concentrate No. 1).

To produce flux coated iron ore pellets in accordance with the present invention, the components taken are the above mentioned concentrate in dry condition and unslaked lime preliminarily pulverized as described in Example 1. These materials are proportioned within 70% of concentrate and 30% of lime and then mixed to produce a uniform mass first in dry condition, then with water which is added to amount to a 15% moisture content in concentrate. The thus produced uniform mass is cured in a thermostat at a temperature of 100° C during 2 hours. Afterwards, the hydrated mixture is added to the dry concentrate in a proportion of 1:2 (by dry weight) for the content of lime in pellets to be 10%. Said components proportioned as described are then mixed together to produce a homogeneous mixture with the addition of water whose amount corresponds to a 5% moisture content in the homogeneous mixture. The resulted homogeneous-mixture charge of pellets is pelletized with adding water in a pan pelletizer 750 mm in diameter, to produce spherically shaped pellets, 18 mm in diameter, containing 8 to 8.5% of moisture. Raw pellets are hardened by hydrothermal treatment in an autoclave similar to that described in Example 1. The results of testing the mechanical strength of pellets are given in Table 2.

EXAMPLE 4

Pellets should be produced to contain 10% of lime, from concentrate prepared from hydrogoethite ores mined at the Lysakovsk deposit in the Northern Kazakhstan by way of magnetizing roasting followed by magnetic beneficiation.

The chemical and grain compositions of the above stated concentrate which will be further called "Lysakovsk concentrate" or concentrate No. 2 are given in Table 1.

Pellets are produced in accordance with the method described in Example 3. The results of testing the mechanical strength of pellets are given in Table 2.

EXAMPLE 5

Pellets should be produced to contain 6% of lime, from roasted and magnetically beneficiated Lysakovsk concentrate (concentrate No. 2 in Table 1). A special requirement is that only 20% of the charge of pellets be subjected to hydration in the course of pellet production and, consequently, a proportion ratio of lime in the hydrated mixture and in the charge of pellets (homogeneous mixture) be equal to 5. Pellets are produced in accordance with the method described in Example 3 or 4. A difference is that the hydrated mixture is proportioned with concentrate in a ratio of 1:4 for the content of lime in pellets to be 6%. The results of testing the mechanical strength of pellets are given in Table 2.

EXAMPLE 6

Pellets should be produced to contain 10% of lime, from a blend of two concentrates, one prepared from hydrogoethite ore of the Lyskovsk deposit in the Northern Kazakhstan by magnetizing roasting and magnetic beneficiation (concentrate No. 2 in Table 1), the other prepared from the same ore by gravity and magnetic beneficiation (called for short, concentrate No. 3).

Moisture content in concentrate No. 2 is 12%, in concentrate No. 3 - 8%.

The chemical and grain compositions of these concentrates are given in Table 1.

To produce pellets in accordance with the present invention the components taken are concentrate No. 2 with 12% moisture content and unslaked lime preliminarily pulverized as described in Example No. 1. These components are proportioned within 82% of concentrate and 18% of lime to correspond by dry weight to the content of 80% of concentrate and 20% of lime, then both are mixed to produce a uniform mixture. The mixture is cured in a thermostat at a temperature of 100° C during 2 hours until lime mixed with damp concentrate is completely hydrated. The hydrated mixture resulted from this process contains 2% of moisture. This mixture is added to concentrate No. 3 (produced by gravity and magnetic beneficiation from Lysakovsk ore) containing 8% of moisture in a proportion of 1:1 (by dry weight) and the both are mixed together to a a. homogeneous mixture - charge of pellets whose moisture content thus comes to be equal to 5%. The resulted charge of pellets is pelletized with adding water into raw pellets containing about 9% of moisture, which then undergo hydrothermal treatment in an autoclave in a way similar to that described in Example 1.

The results of testing the mechanical strength of pellets are given in Table 2.

EXAMPLE 7

Pellets should be produced to contain 15% of lime, from a blend of concentrates used in Example 6.

Moisture content in concentrate No. 2 is 12%, in concentrate No. 3 - 8%. Specifications of these concentrates are brought forth in Table 1. To produce pellets the components are concentrate No. 2 and ground unslaked lime in a proportion of 70% of concentrate and 30% of lime (by dry weight).

Because with the above proportion the 12% content of moisture in concentrate is insufficient for complete hydration of lime, water is later added in the course of mixing these components in an amount corresponding to the 15% moisture content in concentrate. Upon completion of mixing, the uniform mixture is cured in a thermostat at a temperature of 100° C during 0.5 hour. The thus produced hydrated mixture containing 2% of water is added to concentrate No. 3 containing 8% of moisture in a proportion of 1:1 for pellets to contain 15% of lime, afterwards the both are mixed together to produce a homogeneous mixture - charge of pellets with adding water so that the homogeneous mixture contains 8% of moisture. The charge of pellets containing 8% of moisture undergo pelletizing with adding water to produce raw pellets containing 10 to 11% of moisture with further curing in an autoclave in a way similar to that described in Example 1.

The results of testing the mechanical strength of pellets are given in Table 2.

Table 1

Composition of Concentrates Used in Producing Pellets

| 1 | Concentrate No. 1 (magnetite, Kursk Magnetic Anomaly) 2 | Concentrate No. 2 (roasted and magnetically beneficiated, Lysakovsk deposit) 3 | Concentrate No. 3 (gravity and magnetically beneficiated, Lysakovsk deposit) 4 |
|---|---|---|---|
| a)Chemical composition (components) | Content of Components in % | | |
| Fe (total) | 66.02 | 61.43 | 53.80 |
| $Fe_2O_3$ | 64.48 | 54.67 | 76.09 |
| FeO | 26.85 | 29.77 | 0.70 |
| $SiO_2$ | 6.46 | 4.58 | 14.12 |
| CaO | 0.84 | 1.01 | 1.64 |
| MgO | 0.32 | 0.54 | 0.24 |
| $Al_2O_3$ | 0.66 | 5.39 | 4.75 |
| S | 0.02 | 0.01 | 0.015 |
| $P_2O_5$ | 0.08 | 2.16 | 2.30 |
| b) Grain composition (size in mm) | Content of Size in %% | | |
| −1.00+0.63 | 0.46 | 0.02 | — |
| −0.63+0.40 | 0.55 | 0.04 | — |
| −0.40+0.315 | 0.50 | 0.12 | 0.02 |
| −0.315+0.20 | 1.20 | 0.36 | 0.45 |
| −0.20+0.16 | 0.90 | 1.20 | 3.12 |
| −0.16+0.10 | 3.87 | 2.38 | 12.46 |
| −0.10+0.063 | 7.25 | 14.68 | 19.60 |
| −0.063+0.05 | 9.56 | 14.10 | 10.20 |
| −0.05 | 75.71 | 67.10 | 54.15 |
| Total: | 100.00 | 100.00 | 100.00 |

Table 2

Results of Testing the Mechanical Strength of Pellets Produced by the Proposed Method

| | Strength of raw pellets | | | Strength of Autoclaved Pellets | |
|---|---|---|---|---|---|
| | Compressive, kg | Number of drops from | | | |
| Ex. No. | per pellet | 50 cm height | 100 cm height | Compressive, kg per pellet | Number of drops from 200 cm height |
| 1 | 6.0 | over 10 | 6 | 110 | over 10 |
| 2 | 9.5 | " | over 10 | 175 | " |
| 3 | 8.0 | " | 9 | 160 | " |
| 4 | 12.0 | " | over 10 | 190 | " |
| 5 | 8.5 | " | 10 | 135 | " |
| 6 | 16.5 | " | over 10 | 250 | " |
| 7 | 14.5 | " | " | 220 | " |

As can be seen from the results of testing pellets for strength, given in Table 2, pellets produced according to the present invention possess a compressive strength of 110 to 250 kg per pellet and endure more than 10 drops from a 200 cm height down to a steel plate. For comparison, tests have been carried out with pellets produced according to the herein proposed method and with these produced according to an earlier known method (USSR Author's Certificate No. 212,276) including dry mg of raw pellets before their hydrothermal treatment in autocalve and, also of those pellets produced in accordance with the above Author's Certificate but without drying of raw pellets before their hydrothermal treatment. The comparative test results are given in Table 3.

In the Table, pellets produced according to the present invention in the above Examples 3 and 4 are called Pellets No. 1 and Pellets No. 4 respectively. Pellets produced according to an earlier known method from the same concentrates as in Examples 3 and 4 are called Pellets No. 2 and Pellets No. 5, while pellets produced from said concentrates according to a known method but without their drying before hydrothermal treatment are called Pellets No. 3 and Pellets No. 6. All the above mentioned pellets consisted by 90% of the respective concentrate and by 10% of lime.

The comparative test results have proven superiority of the instant method over those mentioned heretofore. This stems from the fact that according to the instant method, hydration does not involve the entire charge of pellets, hydrothermal treatment is effected without preliminary drying of pellets and that produced pellets are of a higher strength than those produced by known methods.

Table 3

Results of Comparative Testing the Mechanical Strength of Pellets Produced According to the Instant Method and to That Known Earlier

| Designation of pellets | Strength of raw pellets: Compressive, kg per pellet | Number of drops from 50 cm height | Number of drops from 100 cm height | Strength of autoclaved pellets: Compressive, kg per pellet | Number of drops from 200 cm height |
|---|---|---|---|---|---|
| Pellets No. 1 | 8.0 | over 10 | 9 | 160 | over 10 |
| Pellets No. 2 | 4.0 | 8 | 2 | 160 | 7 |
| Pellets No. 3 | 4.0 | 8 | 2 | 25 | 0 |
| Pellets No. 4 | 12.0 | over 10 | over 10 | 190 | over 10 |
| Pellets No. 5 | 3.5 | 6 | 1 | 95 | 3 |
| Pellets No. 6 | 3.5 | 6 | 1 | pellets | crushed |

What we claim is:

1. In a method of producing pellets from ore concentrates of particle size less than 0.83 mm, comprising mixing ore concentrate with a binding material, the major portion of which being selected from the group consisting essentially of calcium oxide, magnesium oxide and mixtures thereof to produce a total homogeneous mixture of said components, pelletizing said total homogeneous mixture to produce pellets and curing said pellets in saturated steam at a temperature of from 100° C to 350° C within a time period sufficient for their hardening, the improvement being that said mixing is performed in the following sequential steps:

a. mixing said ore concentrate and said binding material to form a first prepared mixture,
b. subjecting said first prepared mixture to hydration to form a first prepared hydrated mixture,
c. further mixing said first prepared hydrated mixture until homogenous to form a first prepared homogenous hydrated mixture, and
d. mixing said first prepared homogenous hydrated mixture with an additional amount of said ore concentrate to form said total homogeneous mixture so that said total homogenous mixture of said first prepared homogenous hydrated mixture and said additional ore concentrate contains 4 to 15 weight percent of said binding material.

2. In a method of producing pellets from ore concentrates of particle size less than 0.83 mm, comprising mixing ore concentrate with a binding material, the major portion of which being selected from the group consisting essentially of calcium oxide, magnesium oxide and mixtures thereof to produce a total homogenous mixture of said components, pelletizing said total homogenous mixture to produce pellets and curing said pellets in saturated steam at a temperature of from 100° C to 350° C within a time period sufficient for their hardening, the improvement being that said mixing is performed in the following sequential steps:

a. mixing said ore concentrate and an amount of said binding material to form a first prepared mixture,
b. subjecting said first prepared mixture to hydration to form a first prepared hydrated mixture, said amount of said binding material being chosen to correlate with the moisture content of said ore concentrate so that said first prepared hydrated mixture contains from 1 to 2% moisture by weight,
c. further mixing said first prepared mixture to hydration to form a first prepared hydrated mixture.
d. mixing said first prepared homogenous hydrated mixture with an additional amount of said ore concentrate to form said total homogenous mixture so that said total homogenous mixture of said first prepared homogenous hydrated mixture and said additional ore concentrate contains 4 to 15 weight percent of said binding material.

3. The improvement as set forth in claim 1, wherein for preparing the first prepared mixture of the ore concentrate and binding material said components are taken in a proportion by weight percent of 12 to 30 of the binding material and of 70 to 88 of ore concentrate.

4. The improvement as set forth in claim 1, wherein the first prepared hydrated mixture contains 1.5–5 times as much binding material than said total homogenous mixture.

5. The improvement as set forth in claim 1, wherein the first prepared mixture is hydrated by way of its curing in continuous-action reactor bins during a time period of 0.5 to 3 hours, sufficient for complete hydration of calcium oxide.

6. The improvement as set forth in claim 1, wherein the binding material, the major portion of which being selected from the group consisting essentially of, calcium oxide, magnesium oxide, and mixtures thereof, comprises at least 85% calcium oxide and magnesium oxide, with said magnesium oxide being a maximum of 5% of the mixture.

7. The improvement as set forth in claim 1, wherein the binding material is preliminarily pulverized to contain at least 90% of minus 0.1mm size particles.

8. The improvement as set forth in claim 1, wherein the binding material, the major portion of which being selected from the group consisting essentially of calcium oxide, magnesium oxide, and mixtures thereof, comprises a maximum of 5% magnesium oxide.

9. The improvement as set forth in claim 1, wherein the binding material, the major portion of which being selected from the group consisting essentially of calcium oxide, magnesium oxide, and mixtures thereof, comprises at least 85% calcium oxide and magnesium oxide.

* * * * *